US005901527A

United States Patent [19]

Parisi et al.

[11] Patent Number: 5,901,527

[45] **Date of Patent: *May 11, 1999**

[54] WEDGE SPLASH PLATE FOR KRAFT RECOVERY FURNACE BLACK LIQUOR BURNERS

[75] Inventors: John B. Parisi, Totowa, N.J.; Scott C. Moyer, Talladega, Ala.; Edward E. Gayhart, Jr., North Canton; Larry A. Hiner, Orrville, both of Ohio

[73] Assignee: The Babcock & Wilcox Company, New Orleans, La.

[ * ] Notice: This patent issued on a continued prosecution application filed under 37 CFR 1.53(d), and is subject to the twenty year patent term provisions of 35 U.S.C. 154(a)(2).

[21] Appl. No.: 08/779,693

[22] Filed: Jan. 7, 1997

Related U.S. Application Data

[62] Division of application No. 08/347,761, Nov. 30, 1994.

[51] Int. Cl.[6] ..... F23G 7/04

[52] U.S. Cl. ..... 52/750; 239/518; 239/523; 110/238

[58] Field of Search ..... 52/608, 97, 750; 299/23; 144/195.8; 30/308.1; 239/518, 521, 522, 523; 110/238

[56] References Cited

U.S. PATENT DOCUMENTS

| | | |
|---|---|---|
| 3,054,564 | 9/1962 | Flodman . |
| 4,391,068 | 7/1983 | Kosar . |
| 4,416,131 | 11/1983 | Seeger . |
| 4,634,054 | 1/1987 | Grusha . |
| 5,551,354 | 9/1996 | Crofut et al. . |

*Primary Examiner*—Robert Canfield
*Attorney, Agent, or Firm*—Daniel S. Kalka; R. J. Edwards

[57] ABSTRACT

A wedge shaped form is mounted on the splash plate of a black liquor nozzle with the sharp edge of the wedge located at the exhaust of the nozzle to split the black liquor from the nozzle into two flat sheets on each side of the wedge with no droplet formation at the center of the nozzle exhaust.

4 Claims, 5 Drawing Sheets

WEDGE SPLASH PLATE FOR KRAFT RECOVERY FURNACE BLACK LIQUOR BURNERS

This is a divisional of application Ser. No. 08/347,761 filed Nov. 30, 1994.

BACKGROUND OF THE INVENTION

1. Field of the Invention

The present invention relates generally to Kraft recovery furnaces and particularly to black liquor spray nozzles for such furnaces.

2. Description of the Related Art

Kraft recovery furnaces are used to recover useful fuel from the paper making process. In this process logs entering the mill are reduced to chips and are cooked under pressure in a steam-heated aqueous digestion solution of sodium hydroxide and sodium sulfide, known as "white liquor"or "cooking liquor". In the cooking operation, the lignin binder, which holds together the cellulose fibers of the wood, is dissolved.

After cooking, the cellulose fibers, now called "pulp" or "brown stock", are separated from the spent cooking liquor. The pulp may then go through several fiber refining and bleaching processes and finally to the paper machine. The spent cooking liquor containing the lignin dissolved from the wood is called "black liquor". As the diluted or "weak" black liquor (15–18% dissolved solids) comes from the washers, it is first concentrated in a multiple-effect evaporator by the use of steam.

The concentrated or "strong" black liquor then goes to the mix tank where sodium sulfate (salt cake) is mixed with the liquor to make up the chemical losses in the system. Chemical ash recovered from the boiler hoppers and from the fume collector following the direct-contact evaporator is also returned to the liquor cycle. The "heavy" black liquor with its salt-cake burden is heated to lower its viscosity and is then pumped to the recovery furnace. In the furnace, the heavy black liquor is sprayed on the furnace walls for dehydration prior to final combustion of the dried char on the hearth.

The essential function of the recovery unit is the reduction in the furnace of the sodium sulfate content of the black liquor to sodium sulfide.

In the recovery furnace, heat obtained from the combustion of the organic liquor constituents dissolved from the wood is recovered in production of steam, and the inorganic sodium constituents in the liquor are recovered as molten smelt, composed largely of sodium carbonate, $Na_2CO_3$, sodium sulfide, $Na_2S$.

The spray of the black liquor into the recovery furnace is done by black liquor burners having spray nozzles therein.

There are two designs of liquor burners, the oscillator and the limited vertical sweep (LVS). Both types of burners utilize a nozzle splash plate to produce a sheet spray of coarse droplets.

The oscillator spray controls the black liquor distribution on the furnace walls, where it is dehydrated and falls to the char bed. The oscillator burners typically are located in the center of the furnace wall between the secondary and tertiary air ports, are continuously rotated and oscillated, spraying liquor in a figure eight pattern to cover a wide band of the walls above the hearth.

In the LVS burners shown in FIG. 1, black liquor is sprayed into the furnace for more in-flight drying and devolatization of the combustible gas stream rising from the char bed. The objective of the LVS burner is to minimize the liquor on the wall. The LVS gun is normally used in a fixed position, but can also sweep vertically to burn low solid liquor or those with poor burning characteristics.

The temperature and pressure of atomized liquor directly impacts recovery furnace operations. Lower temperature and pressure generally create a larger particle or droplet of atomized liquor. This minimizes the entrainment of liquor in the combustion gases passing to the heat absorbing surfaces. Where wall drying is carried out, large liquor droplets maximize the liquor sprayed on the wall and minimize in-flight drying.

As the liquor sprayed on the walls builds, it eventually falls to the char hearth. The majority of the char falling from the wall is deposited in front of the primary air ports, requiring 40 to 50% of the primary air to be introduced through the primary ports.

The basic splash plate for these known spray nozzles has been used in recovery boilers. FIG. 1 shows a typical spray nozzle burner with a splash plate nozzle mounted on the burner pipe. FIG. 2 shows a spray gun black liquor distribution pattern from such known burner nozzles.

The concept of splitting the liquor flow in burner spray nozzles is also known. Past, known experimentation used a vertical pin, or cylinder, whose flat end was fastened to the splash plate. Such modified sprayer plates were used on recovery boilers approximately 20 years ago. The embodiment was too erratic in operation and did not provide any benefits and did not receive acceptance in the industry. About the same time, Gotaverken Heat Engineering in Sweden experimented unsuccessfully with a pin mounted on a splash plate.

Thus to date there has not been a successful spray nozzle for black liquor that would split the flow into two opposed flat sheets of black liquor that was controllable without producing splatter and large drop buildup on the walls of the recovery furnace.

SUMMARY OF THE INVENTION

The present invention solves the problems associated with prior art spray nozzles and splash plates as well as others by mounting a diverter assembly formed as a wedge shaped assembly on the splash plate of a conventional splash plate nozzle. The nozzle splash plate wedge assembly could be made as a solid wedge or a hollow one without affecting the functional operation of the wedge assembly.

The wedge assembly splits the black liquor stream flowing from the nozzle into two streams. The streams are admitted into the recovery furnace as two opposed, flat sheet of liquor. The wedge assembly is formed to have contoured faces formed as arcs of a circle of a predetermined radius to provide a liquor-free, angle segment (void) at the end of the nozzle, without using a larger wedge, i.e., greater segment of a circle. (A larger wedge would be more difficult to keep cooled.) Secondly, the contour creates a flow off the end of the splash plate that is moved outward, i.e., away from the outer corner of the wedge so that the liquor does not curl inward towards the nozzle centerline, which would result in splatter and uncontrolled liquor entering into the furnace that could contribute to carryover.

The splitting of the liquor stream controls liquor distribution to selected perimeter walls rather than the center of the furnace bed. If the black liquor goes to the center of the bed, the bed pile builds an inventory and cannot be controlled with the black liquor introduction. Perimeter distribution prevents the bed piling in the center of the furnace.

In view of the foregoing it will be seen that one aspect of the present invention is to provide a spray nozzle splash plate that will split the black liquor into two opposed flat sheets of liquor without causing splattering and droplet formation.

Another aspect of the present invention is to provide a spray nozzle splash plate that does not splatter and emit uncontrolled liquor into the middle of the furnace bed.

These and other aspects of the present invention will be more fully understood after a review of the following description of the preferred embodiment in conjunction with the accompanying drawings.

DESCRIPTION OF THE PREFERRED EMBODIMENT

Figure 1:
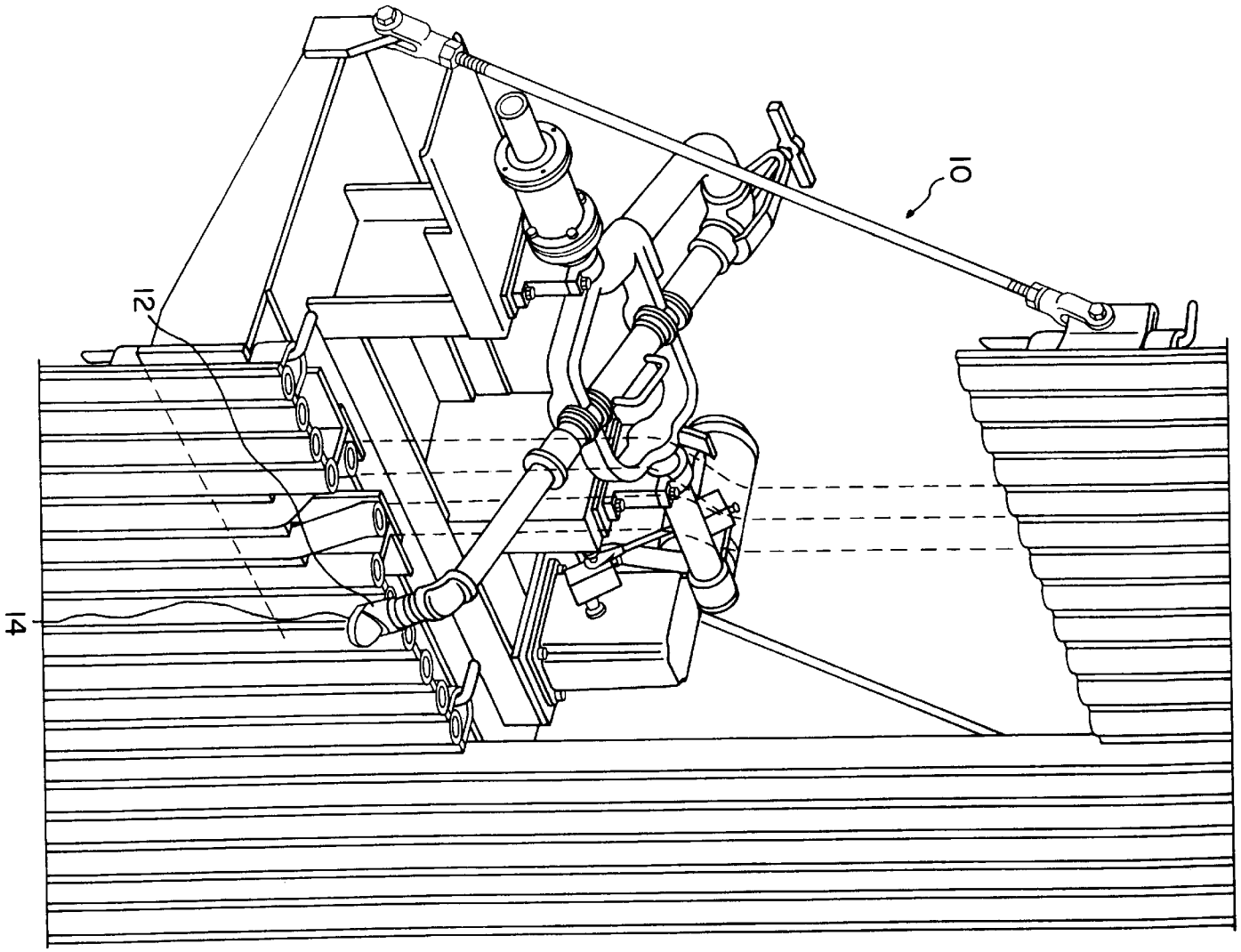
FIG. 1 PRIOR ART
FIG. 1 is a schematic of an LVS prior art spray nozzle having a prior art splash plate.
Figure 2:
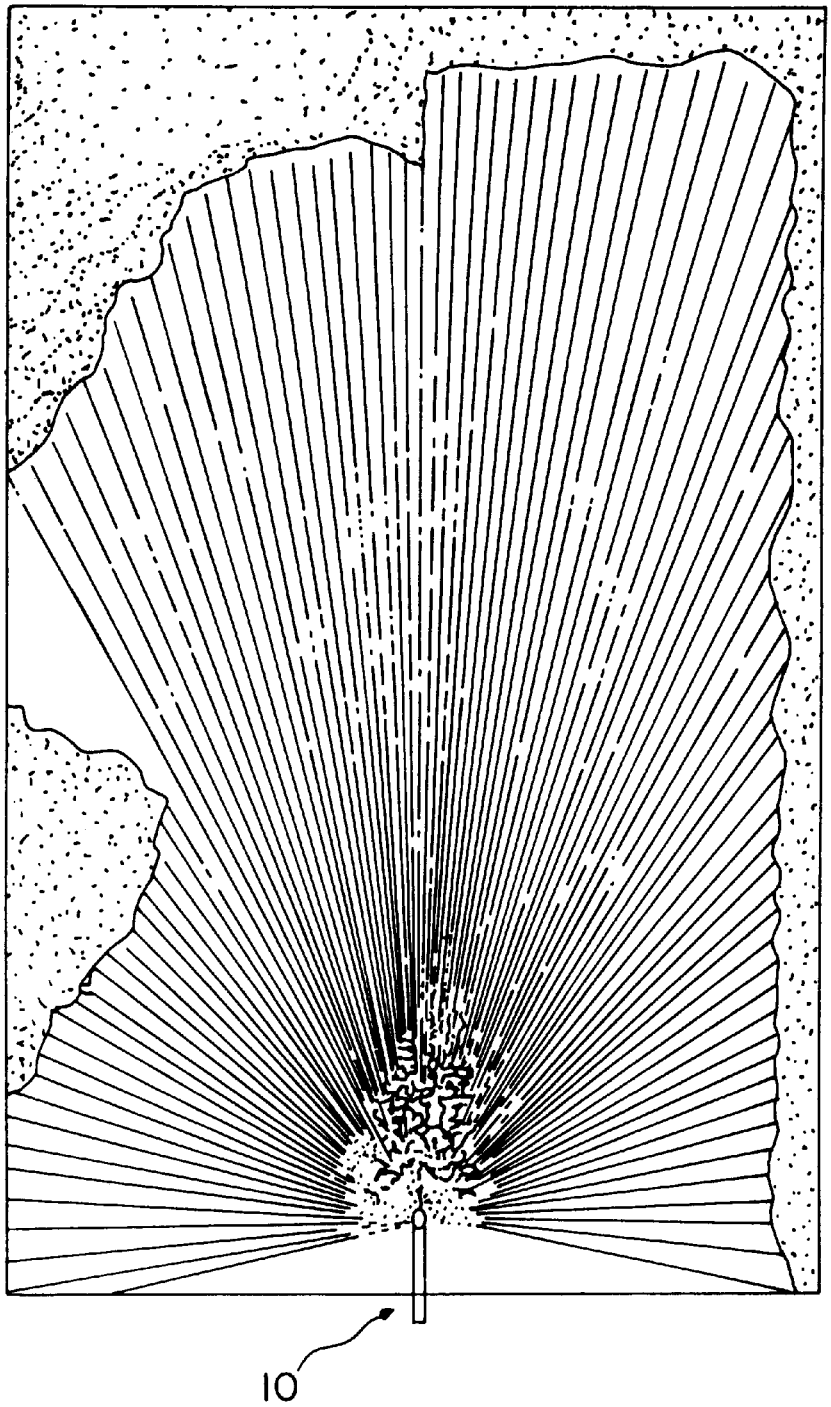
FIG. 2 PRIOR ART
FIG. 2 is a depiction of the char distribution on the recovery furnace walls using the prior art LVS spray nozzle and splash plate shown in FIG. 1.
Figure 3:
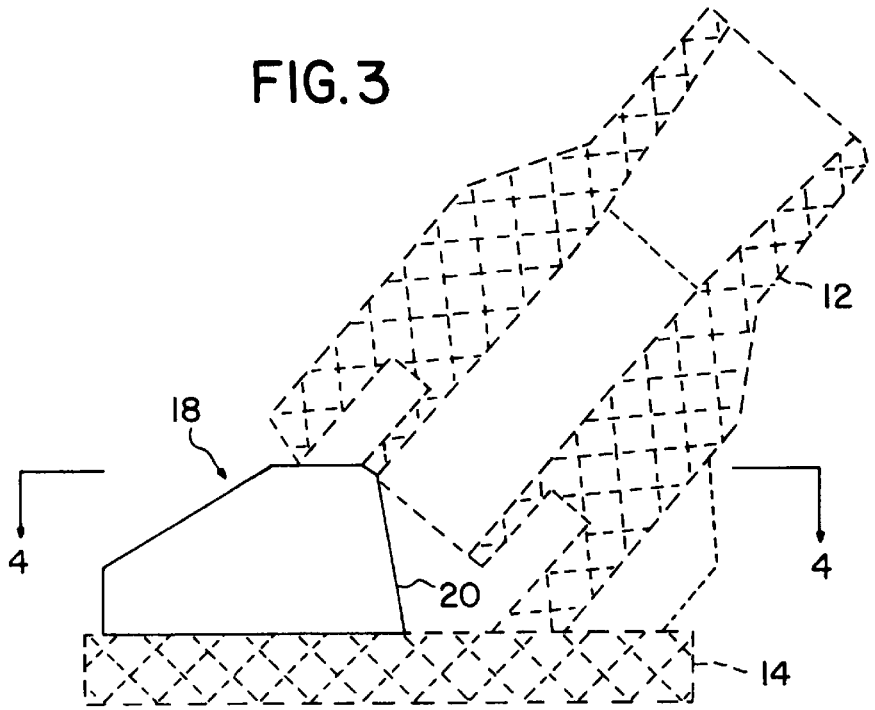
FIG. 3 is a side view of the FIG. 1 spray nozzle in phantom with the wedge splash plate of the present invention.
Figure 4:
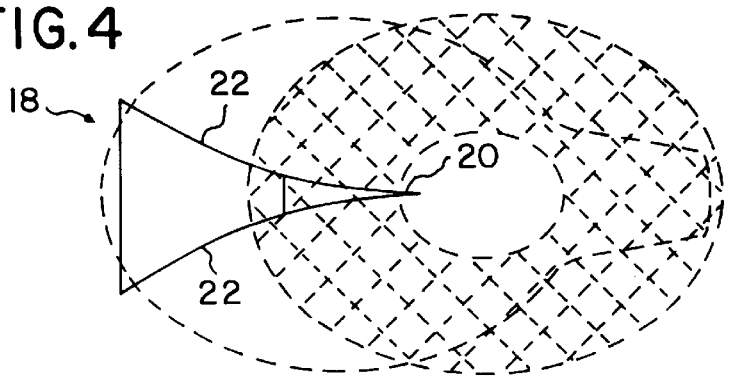
FIG. 4 is a cross sectional view taken along section A—A of the FIG. 3 spray nozzle and wedge splash plate.
Figure 5:
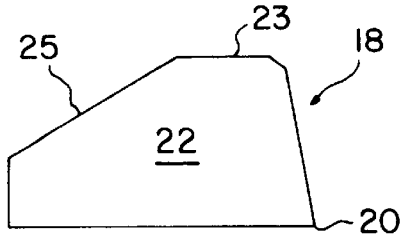
FIG. 5 is a side view of the wedge of the present invention.
Figure 6:
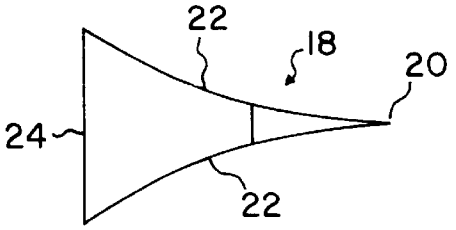
FIG. 6 is a top view of the FIG. 5 wedge.
Figure 7:
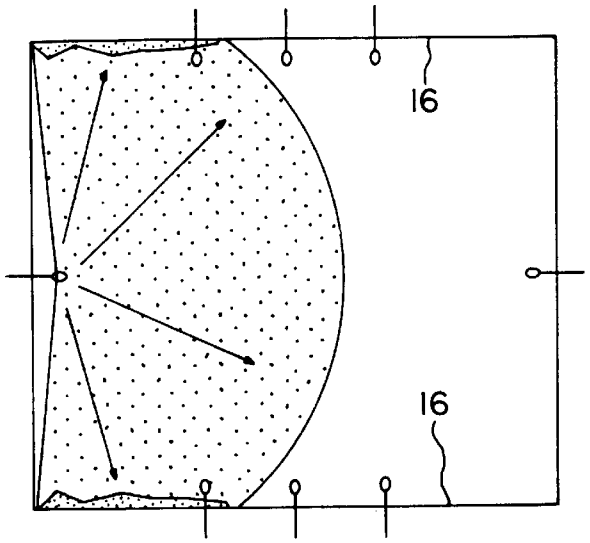
FIG. 7 is a plan view of the black liquor spray pattern from the FIG. 1 spray nozzle.
Figure 8:
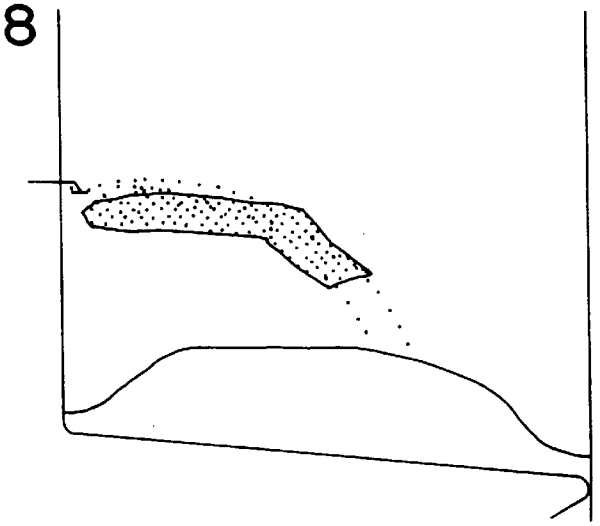
FIG. 8 is a side view of the FIG. 7 spray pattern.
Figure 12:
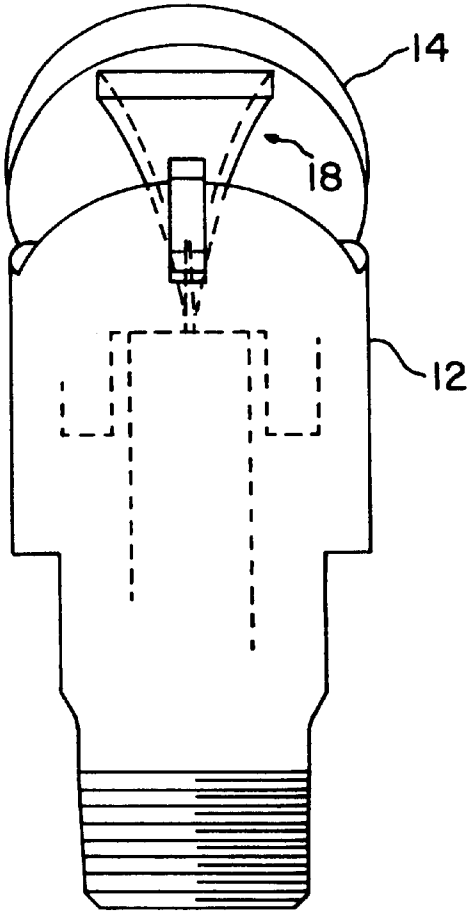
FIG. 12 is a front view of the spray nozzle and wedge.
Figure 11:
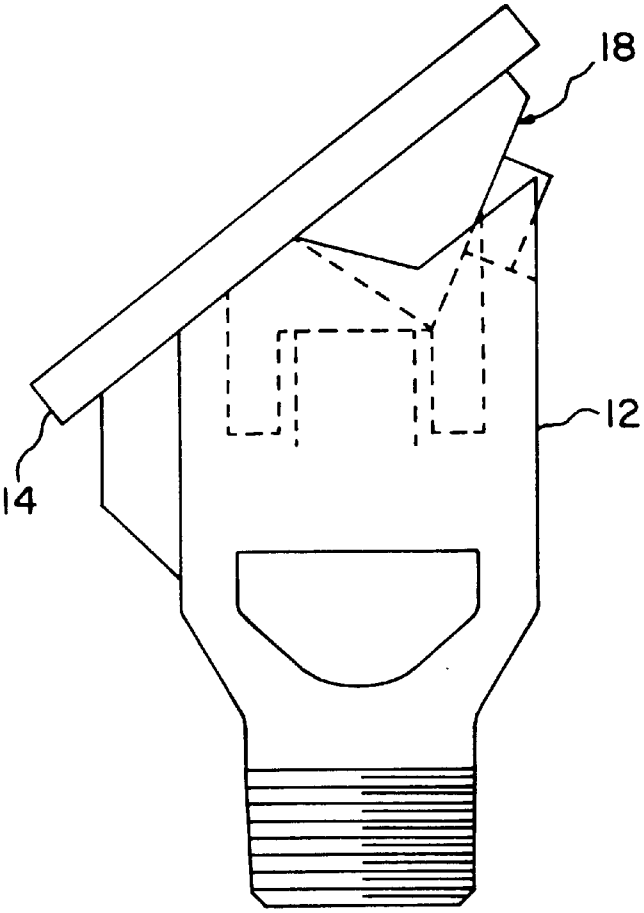
FIG. 11 is a side view of the spray nozzle and wedge.

Turning now to FIGS. 1 and 2, it will be seen that the prior art limited sweep burner assembly 10 has a spray nozzle 12 and a flat splash plate 14 which provides a char distribution on furnace walls 16 as may be best seen in FIGS. 2, 7, and 8. The operation of this burner assembly and the associated problems associated therewith were described in the related art description provided earlier and will not be repeated herein.

Turning now to FIGS. 3–6, 11 and 12 it is seen that the operation of the assembly 10 is significantly improved by mounting a nozzle wedge assembly 18 on the splash plate 14 of the burner assembly 10 to have the nozzle 12 exhaust at a predetermined angle on the pointed edge 20 of the wedge assembly 18. The pointed edge 20 adjacent to the nozzle 12 provides a sharp split of the liquor flow from the nozzle 12 to minimize splatter and large droplet formation. It was found through experimentation that a blunt edge resulted in considerable splatter of liquor droplets Extending from the sharp edge point 20 the wedge assembly 18 has contoured surfaces 22 formed as arcs of a 5 inch radius circle. The top surface of the wedge assembly is formed from a straight cover 23 extending partially over the wedge and finishing with an angled surface 25 extending to an end plate 24 to complete the top surface covering. The wedge could be either solid or hollow without any change in the functional operation also, the end plate could be removed in a hollow wedge to provide an open ended hollow wedge.

Figure 9:
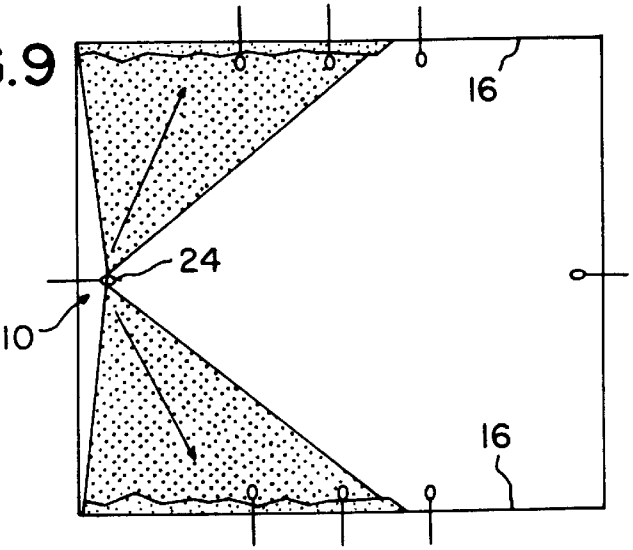
FIG. 9 is a plan view of the black liquor spray pattern from the FIG. 3 spray nozzle and splash plate.
Figure 10:
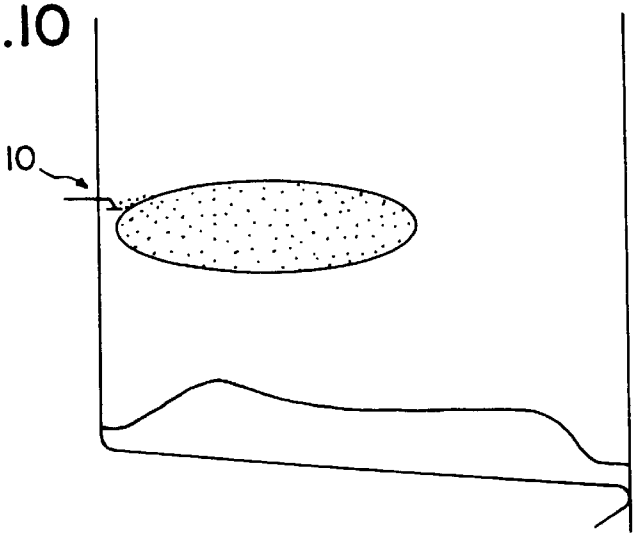
FIG. 10 is a side view of the FIG. 9 spray pattern.

With any of the described wedge assemblies, the contoured surfaces 22 split the liquor stream issuing from the nozzle 12 into two flat sheets, one from each side of the wedge assembly 18 with the central area extending from the area of the end 24 into the furnace being void. This effect is best seen in FIGS. 9 and 10. Thus the wedge assembly 18 controls liquor distribution to related perimeter walls 16 of the furnace rather than the center of the furnace bid, thereby preventing the bed piling in the center of the furnace.

The primary air (used as the first level of a three level staged combustion) is at the furnace perimeter. Perimeter distribution of liquor gets the carbon char devolatized liquor consisting of carbon bound to inorganic chemicals) to the air supply and prevents the bed piling in the center of the furnace. If the bed builds, the control of the height requires excessive secondary air to burn the bed material or causes suspension burning of the liquor char. In either case, there is excessive sodium fuming of liquor carryover to the convection passes, which causes plugging of heat transfer surfaces.

Perimeter distribution shortens the distance the liquor particles must travel before impinging on the furnace wall. When liquor is introduced with a standard splash plate nozzle, droplets must traverse twice the distance to reach the opposing wall, resulting in excessive droplet combustion in flight. An objective of the designers is to shorten the distance traveled by the black liquor droplets so that the char material is deposited on the walls and falls in front of the primary air ports, where it can be properly burned.

Also, the wedge assembly divides the liquor with little or no separation of liquor from the sheet, that is, little or no errant droplets (splashing). The contours 22 when compared to a flat face, confined the sheet formed on each side of the wedge 18 to a uniform distribution of liquor through to the flat spray sheets.

Testing to date determined that distribution of liquor to the perimeter of the furnace by this wedge assembly 18 results in the ability to operate the recovery furnace with a significant decrease in inorganic smelt carryover to the convection surfaces. This enhances the ability to keep surfaces clean to the extent that superheater steam temperature does not decrease and the surface does not plug with the inorganic chemical.

Certain modifications and additions have been deleted herein for the sake of conciseness and readability. For example, the wedge splatter could take other forms such as a diamond shaped bar extending between the top of the nozzle and the end of the splash plate with the pointed side of the bar facing the nozzle opening. Care should be taken to prevent a blunt device which results in considerable splatter of liquor droplets. It will be understood that all such additions and modifications are considered to be within the scope of the following claims.

What is claimed is:

1. A wedge shaped splash plate for mounting at the exhaust of a black liquor nozzle comprising:

a flat plate;

a pair of contoured side surfaces extending up from said plate to a sharp edge located at one end of said plate;

an angled top surface extending over the top of said contour side surfaces;

a back wall connecting ends of said pair of contoured side surfaces to form an enclosed wedge shaped form on said flat plate; and wherein said wedge shaped form is hollow.

2. A wedge shaped splash plate for mounting at the exhaust of a black liquor nozzle comprising:

a flat plate constructed to be mounted at a predetermined angle onto said black liquor nozzle;

a pair of contoured side surfaces extending up from said plate to a sharp edge located at one end of said plate;

an angled top surface extending over the top of said contoured side surfaces; and wherein said contoured side surfaces form arcs of a five inch radius circle.

3. A wedge shaped splash plate as set forth in claim 2, including a back wall connecting ends of said pair of contoured side surfaces to form an enclosed wedge shaped form on said flat plate.

4. A wedge shaped splash plate as set forth in claim 3, wherein said wedge shaped form is solid.

* * * * *